US011913644B2

(12) United States Patent
McDaniel

(10) Patent No.: US 11,913,644 B2
(45) Date of Patent: Feb. 27, 2024

(54) INVERTING POCKET LIGHTERS

(71) Applicant: VPR Brands, LP, Ft Lauderdale, FL (US)

(72) Inventor: Kegan McDaniel, Milwaukee, WI (US)

(73) Assignee: VPR Brands, LP, Ft Lauderdale, FL (US)

( * ) Notice: Subject to any disclaimer, the term of this patent is extended or adjusted under 35 U.S.C. 154(b) by 394 days.

(21) Appl. No.: 17/201,921

(22) Filed: Mar. 15, 2021

(65) Prior Publication Data

US 2021/0199294 A1 Jul. 1, 2021

Related U.S. Application Data

(63) Continuation of application No. 16/196,510, filed on Nov. 20, 2018, now Pat. No. 10,948,187.

(60) Provisional application No. 62/589,350, filed on Nov. 21, 2017.

(51) Int. Cl.

| | |
|---|---|
| ***F23Q 2/00*** | (2006.01) |
| ***F23Q 2/06*** | (2006.01) |
| ***F23Q 2/36*** | (2006.01) |

(52) U.S. Cl.
CPC *F23Q 2/36* (2013.01); *F23Q 2/06* (2013.01)

(58) Field of Classification Search
CPC ..... F23Q 2/36; F23Q 2/06
USPC ..... 431/146
See application file for complete search history.

(56) References Cited

U.S. PATENT DOCUMENTS 2,530,291 A 11/1950 Conway et al.
2,572,863 A * 10/1951 Jaap ..... A24F 19/10 206/86
3,695,815 A * 10/1972 Schaefer ..... F23Q 2/32 431/344
5,740,905 A 4/1998 Kilfoy
6,264,463 B1 7/2001 Sung
6,293,783 B1 9/2001 Lee
6,295,991 B1 * 10/2001 Emery ..... A24F 13/26 131/249
D468,055 S 12/2002 Harel
(Continued)

FOREIGN PATENT DOCUMENTS

CN 3063895 9/1997
CN 3268050 12/2002
(Continued)

OTHER PUBLICATIONS

United States Patent and Trademark Office, "Notice of Allowance and Fee(s) Due", issued in connection with U.S. Appl. No. 16/196,510 dated on Nov. 12, 2020, 14 pages.
(Continued)

*Primary Examiner* — Avinash A Savani
(74) *Attorney, Agent, or Firm* — Hanley, Flight & Zimmerman, LLC

(57) ABSTRACT

Inverting pocket lighters are described herein. An example pocket lighter includes a body having a first side wall, a second side wall opposite the first side wall, an end wall between the first side and the second side, and an opening extending through the body between the first side wall and the second side wall. The opening is dimensioned to receive a finger of a person. The example pocket lighter also includes a lighter assembly at least partially disposed in the body. The lighter assembly includes a nozzle and a button to open the nozzle when activated.

20 Claims, 4 Drawing Sheets

(56) References Cited

U.S. PATENT DOCUMENTS

| | | | | |
|---|---|---|---|---|
| 6,491,515 | B1 | 12/2002 | Tubby et al. | |
| 9,187,237 | B1 * | 11/2015 | Pedotto, Jr. | F23Q 2/44 |
| D757,354 | S | 5/2016 | Tong | |
| 2001/0029002 | A1 | 10/2001 | Cook | |
| 2004/0142293 | A1 | 7/2004 | Smith | |
| 2012/0152225 | A1 | 6/2012 | Mitchell | |
| 2012/0240949 | A1 | 9/2012 | Spurling, III | |
| 2017/0241642 | A1 | 8/2017 | Kaplan | |
| 2018/0007955 | A1 | 1/2018 | Nelson et al. | |
| 2018/0192696 | A1 | 7/2018 | Narducci | |
| 2019/0154258 | A1 | 5/2019 | McDaniel | |

FOREIGN PATENT DOCUMENTS

| | | | | |
|---|---|---|---|---|
| CN | 3393716 | | 9/2004 | |
| CN | 302425478 | | 5/2013 | |
| CN | 304323586 | | 10/2017 | |
| CN | 304836244 | | 9/2018 | |
| CN | 305298852 | | 8/2019 | |
| FR | 112705-0004 | | 7/1974 | |
| FR | 112705-0006 | | 7/1974 | |
| WO | WO-2007005488 | A2 * | 1/2007 | A24F 13/24 |

OTHER PUBLICATIONS

United States Patent and Trademark Office, "Non-Final Office Action", issued in connection with U.S. Appl. No. 16/196,510 dated Jun. 1, 2020, 7 pages.

China National Intellectual Property Administration, "Evaluation Report," issued in connection with Application No. 201930608297.3, dated Mar. 27, 2021, 4 pages.

* cited by examiner

INVERTING POCKET LIGHTERS

RELATED APPLICATION

This patent arises from a continuation of U.S. application Ser. No. 16/196,510 (now U.S. Pat. No. 10,948,187), titled "Inverting Pocket Lighters," filed Nov. 20, 2018, which claims the benefit under 35 U.S.C. § 119(e) of U.S. Provisional Patent Application No. 62/589,350, titled "Inverting Pocket Lighters," filed Nov. 21, 2017, both of which are hereby incorporated by this reference in their entireties.

FIELD OF THE DISCLOSURE

This disclosure relates generally to pocket lighters and, more particularly, to inverting pocket lighters.

BACKGROUND

Pocket lighters are available in many shapes, sizes, and styles. Most pocket lighters have an elongated body or housing containing lighter fluid and a button or trigger located at one end of the housing that is used to activate the lighter to produce a flame. To use the pocket lighter, the pocket lighter is typically grasped in the hand of a person and the person uses his/her finger (e.g., thumb) to press the button or trigger to produce the flame.

Figure 3:
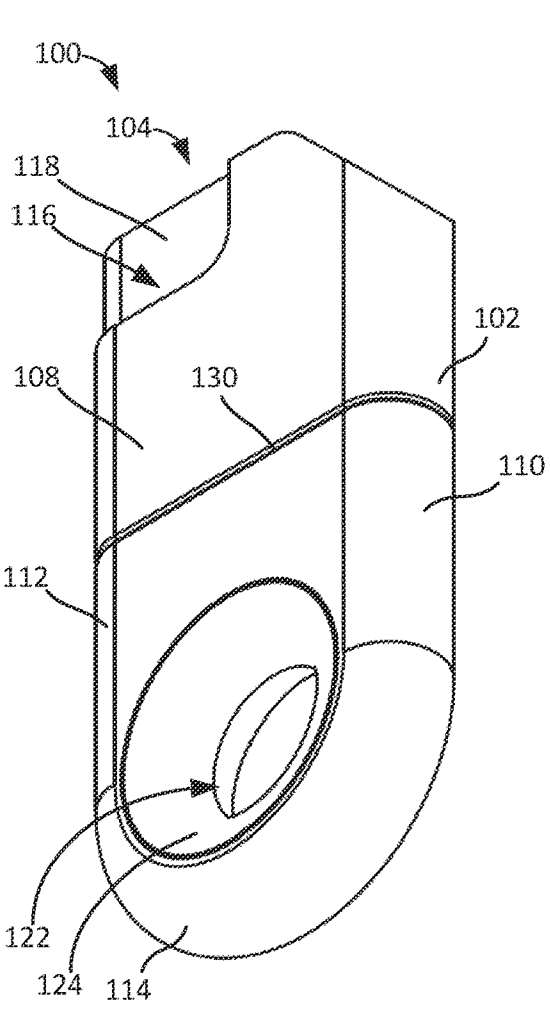
FIG. 3 is a bottom perspective view showing a different side of the example pocket lighter of FIG. 1.

The figures are not to scale. Instead, to clarify multiple layers and regions, the thickness of the layers may be enlarged in the drawings. Wherever possible, the same reference numbers will be used throughout the drawing(s) and accompanying written description to refer to the same or like parts. As used in this patent, stating that any part (e.g., a layer, film, area, or plate) is in any way positioned on (e.g., positioned on, located on, disposed on, or formed on, etc.) another part, indicates that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

Known pocket lighters are generally rectangular or cylindrically shaped and have a button, trigger, or lighting mechanism on one end. Pocket lighters are used for a variety of purposes, such as lighting a cigarette, lighting a fire, starting a grill, lighting a candle, etc. To light an object such as a cigarette, for example, the pocket lighter can be held in a person's hand in a generally vertical or upright orientation such that the flame points upward. However, to light an object such as smoking material in a pipe or other upward facing receptacle, the person has to invert the lighter by turning his/her hand over (e.g., 180° from the upright orientation) to point the flame downward toward the object. This position can be uncomfortable for the person and/or may not be achievable if the person's wrist and/or hand movements are limited (e.g., due a medical condition). Also, when the person's hand is turned over, he/she may not be able to see the flame because his/her thumb (or other part of the hand) obstructs the person's view of the flame. As such, the person is prone to burn her/her hand that is holding the lighter.

Disclosed herein are example pocket lighters having openings through which a person may insert his/her finger and to enable the person to easily invert the lighter without having to twist his/her hand into an uncomfortable position. Further, by enabling the person to hold the lighter in an inverted positon without having to turn his/hand over, the example pocket lighter enables the person to maintain a direct line-of-sight see to the flame, thereby avoiding accidental burns.

An example pocket lighter disclosed herein includes a body or housing with an open top and a lighter assembly at least partially disposed within the body. As used herein, the term lighter assembly means the one or more components used to create a flame, such as a button, a spark wheel, a stone, an adjusting wheel, a nozzle, a wick or tube, and/or fuel. In some examples, a button of the lighter assembly is disposed above the open top and may be pressed by a person to activate the lighter. The example pocket lighter includes an opening extending through the body (e.g., in a direction perpendicular to a longitudinal axis of the body). A person may insert his/her index finger, for example, through the opening. Then, the person may activate the lighter by pressing the button on the end of the pocket lighter by squeezing the pocket lighter between his/her thumb and index finger to depress the button (and/or rotate a spark wheel, depending on the type of lighter assembly implemented in the pocket lighter). When using the example pocket lighter in an inverted or upside-down position, for example, the person's hand can remain in a generally horizontal orientation (e.g., with the back of the hand facing upward). As a result, the person does not have to turn his/her hand over to an uncomfortable position, as required with known pocket lighters.

Figure 2:
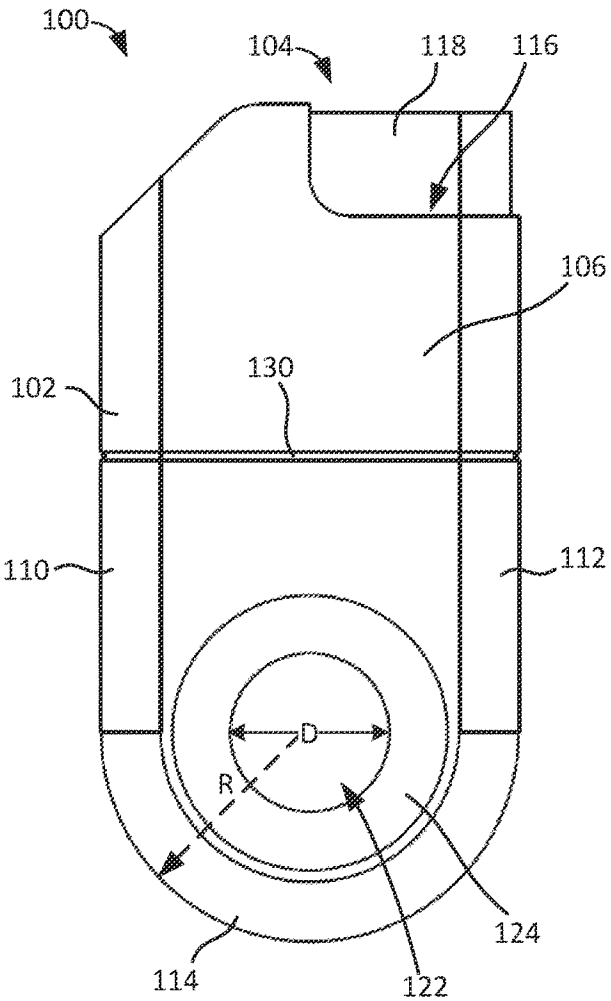
FIG. 2 is a side view of the example pocket lighter of FIG. 1.
Figure 1:
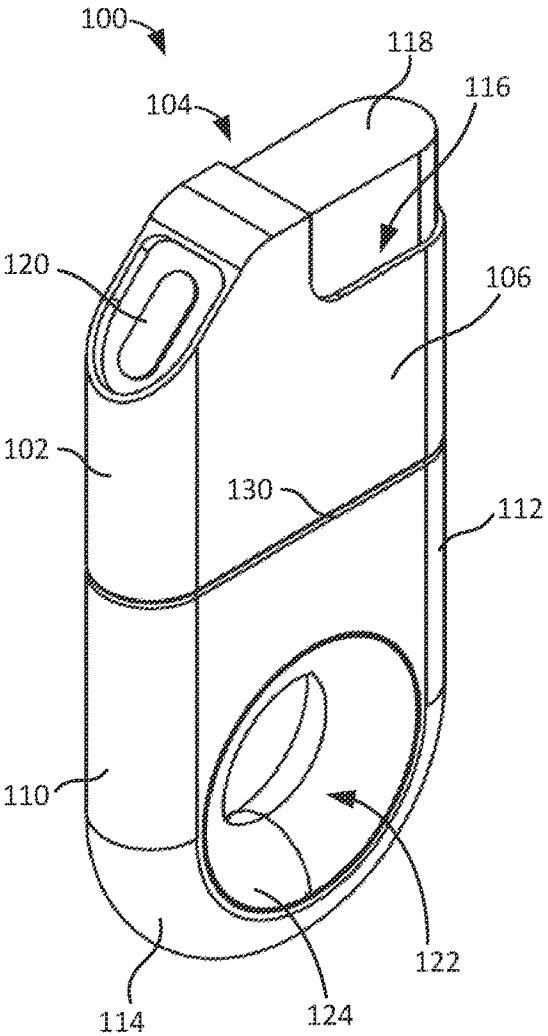
FIG. 1 is a top perspective view of an example pocket lighter having an example body with an example opening and constructed in accordance with the teachings of this disclosure.

Turning now to the figures, FIGS. 1-3 illustrate an example pocket lighter 100 constructed in accordance with the teachings of this disclosure. In the illustrated example, the pocket lighter 100 includes a body 102 (sometimes referring to as a housing or casing) and a lighter assembly 104 disposed at least partially in the body 102. The lighter assembly 104 includes one or more components (e.g., lighter fluid, a wick, a spark wheel, etc.) to produce a flame, as disclosed in further detail herein. In the illustrated example, the pocket lighter 100 is relatively small (compared to a stick or utility lighter, for instance) and is sized to fit comfortably in a pocket of an article of clothing.

In the illustrated example, the body 102 includes a first side wall 106 (FIGS. 1 and 2) and a second side wall 108 (FIG. 3) opposite the first side wall 106. The first and second side walls 106, 108 are substantially flat and parallel to each other. The body 102 further includes a first end wall 110 (e.g., a third side wall) between the first and second side walls 106, 108 and a second end wall 112 (e.g., a fourth side wall) opposite the first end wall 110 between the first and second side walls 106, 108. The body 102 also includes a bottom end wall 114 and an open top 116 opposite the bottom end wall 114.

The lighter assembly 104 is at least partially disposed within a cavity in the body 102 (e.g., defined at least in part by the first side wall 106, the second side wall 108, the first end wall 110, the second end wall 112, and/or the bottom end wall 114) and extends from the open top 116. In the illustrated example, the lighter assembly 104 is implemented as a click button lighter assembly and includes a button 118 and a nozzle 120. When the button 118 is activated or triggered (e.g., pushed, depressed, etc.), a valve in the nozzle 120 is opened that allows a flammable fluid (e.g., Naphtha, butane, etc.) to flow from the nozzle 120 and a spark is created near the nozzle 120, thereby creating a flame at the nozzle 120. In some examples, the flame is maintained at the nozzle 120 as long as the button 118 is triggered (or until the lighter fluid is gone). In the illustrated example, the button 118 extends from the open top 116 near the second end wall 112, and the nozzle 120 is positioned near the first end wall 110. In this example, the button 118 may be pushed or depressed in a direction into the body 102 (into the cavity toward the bottom end wall 114). In other examples, the button 118 may be moved in another direction to activate the lighter assembly 104 to produce a flame.

In some examples, the lighter assembly 104 is a Naphtha-based lighter assembly and includes Naphtha fluid disposed in the body 102. In other examples, the lighter assembly 104 may contain other types of fluid (e.g., butane). Further, while in the illustrated example the lighter assembly 104 is implemented as a click button lighter assembly, in other examples, the lighter assembly 104 may be implemented as another type of lighter assembly, such as an electric arc lighter, a lighter assembly having a spark wheel, etc. In some examples, the lighter assembly 104 is removable from the body 102. In other examples, the lighter assembly 104 is integrally constructed with the body 102 (e.g., such that removal of the lighter assembly 104 may damage or destroy the pocket lighter 100).

Figure 4:
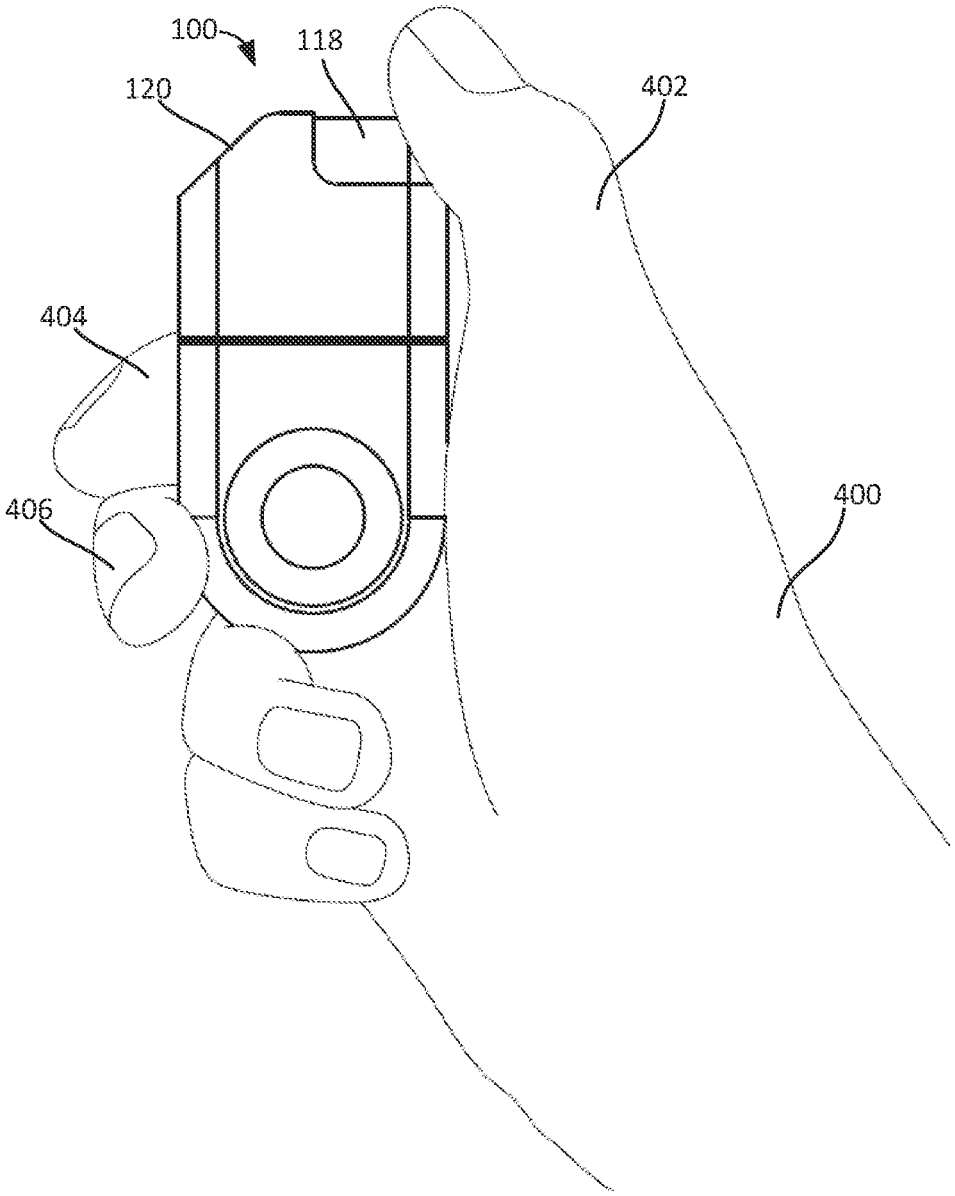
FIG. 4 shows the example pocket lighter of FIG. 1 in a right hand of a person and oriented in a generally upright position.

FIG. 4 shows an example of a person holding the pocket lighter 100 with his/her right hand 400. In the illustrated example, the pocket lighter 100 is held in a substantially vertical or upright orientation, where the person may use his/her thumb 402 (or another finger) to press the button 118 to produce a flame at the nozzle 120. In the illustrated example, the pocket lighter 100 is grasped in the person's hand by using his/her index finger 404 and middle finger 406 to hold the pocket lighter 100 against the person's palm. In other examples, the pocket lighter 100 may be held in a different position in the person's hand 400 and/or between other parts/fingers of the person's hand 400.

Referring back to FIGS. 1-3, the body 102 of the example pocket lighter 100 includes an opening 122 (e.g., a hole, an aperture, etc.) defined by an inner surface 124 extending through the body 102 between the first side wall 106 and the second side wall 108. The opening 122 is dimensioned to receive one or more fingers (e.g., an index finger) or a portion of a finger of a person when using the pocket lighter 100. The example opening 122 enables a person to activate the pocket lighter 100 using a different hand position and/or motion that is easier and more comfortable to hold.

Figure 5:
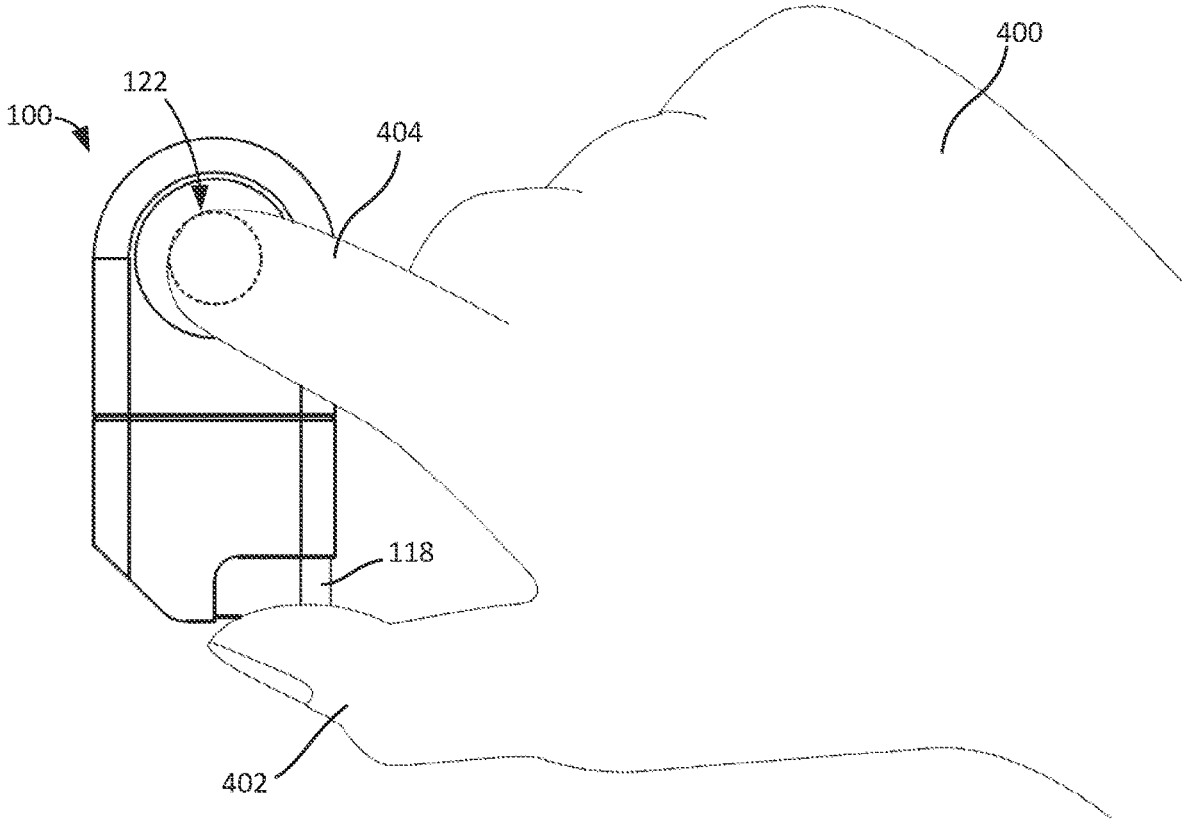
FIG. 5 shows the example pocket lighter of FIG. 1 in a right hand of a person and oriented in a generally inverted or upside-down position.
Figure 6:
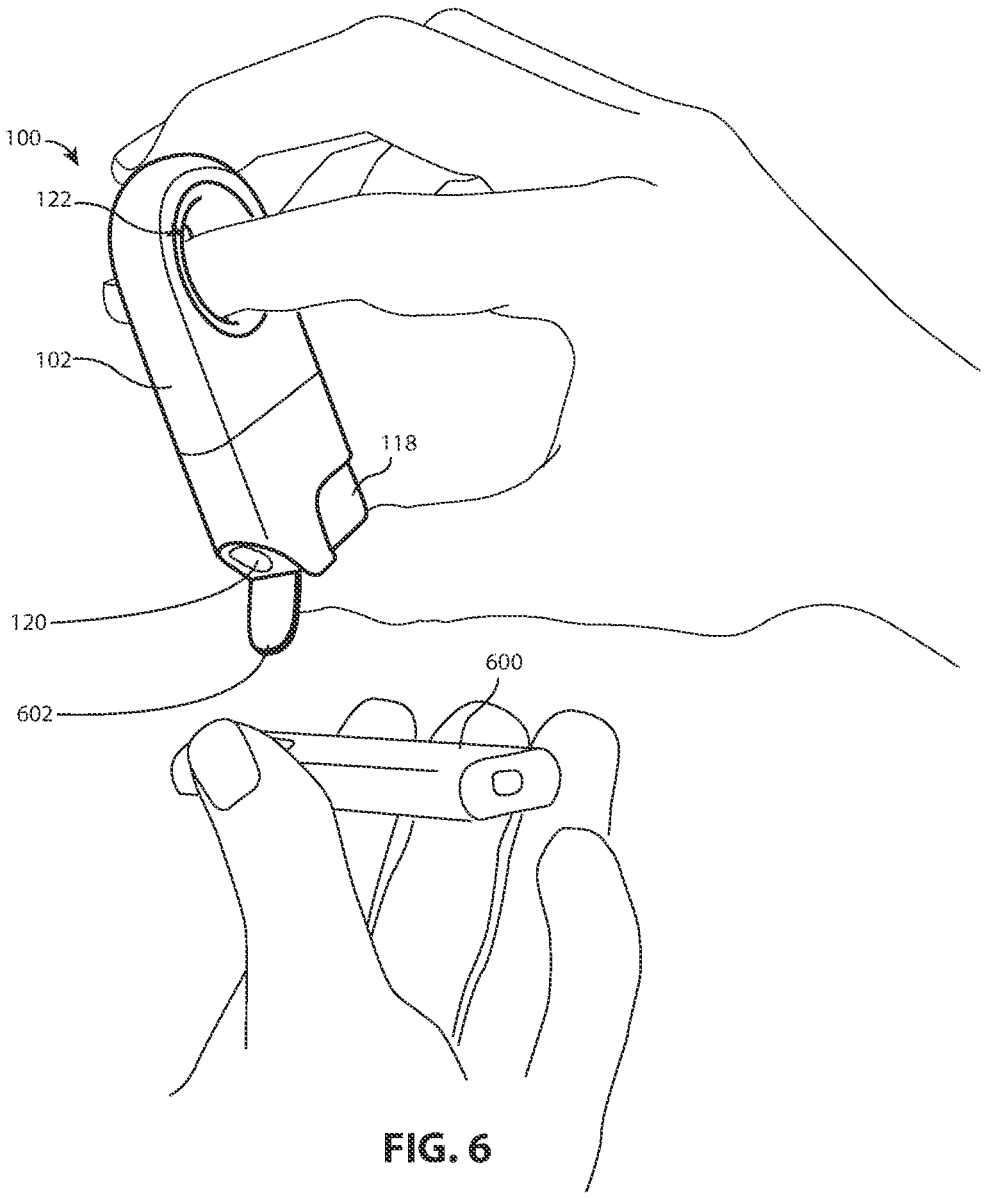
FIG. 6 shows the example pocket lighter of FIG. 1 in the inverted position from another angle.

For example, FIG. 5 shows an example of the person holding the pocket lighter 100 in an inverted or upside-down position. As illustrated, the person may insert his/her index finger 404 through (or partially into) the opening 122 and use his/her thumb 402 to push the button 118 (e.g., by moving (e.g., squeezing) his/her index finger 404 and thumb 402 toward each other). As shown, in this position, the person's hand 400 does not have to be turned upside-down into an uncomfortable positon to the hold the pocket lighter 100. Instead, the person can maintain his/her hand 400 in a relatively comfortable position (e.g., with the back of the hand 400 generally facing upward) and use the example pocket lighter 100. The example pocket lighter 100 can be held in this fashion and rotated or turned in any direction. FIG. 6 shows another view of the person using the pocket lighter 100 in a substantially inverted or upside-down position to light a smoking device 600. As shown, the pocket lighter 100 can be easily held in a position where the person's fingers do not block his/her line-of-sight to the flame, thereby avoiding accidents. In the illustrated example of FIG. 6, the pocket lighter 100 is depicted has having a lid or cover 602 that is pivotably coupled to the body 102. The cover 602 is pivotable between a closed position to cover the nozzle 120 and an open position to uncover the nozzle 120. In some examples, the cover 602 is moved from the closed positon to the open position when the button 118 is depressed.

An example method of using the pocket lighter may include inserting a finger (e.g., an index finger) wholly or partially into the opening 122 in the body 102. Then, the person may turn the pocket lighter 100 to the desired orientation by twisting or rotating his/her hand and/or rotating the pocket lighter 100 about the person's finger. Once in the desired position, the person may press the button 118 with his/her thumb (or another finger), for example, by moving the thumb and index finger toward each other, thereby squeezing the pocket lighter between the two fingers. In other examples, the opening 122 may be dimensioned to receive more than one finger of a person, such that the person can insert two or more fingers (e.g., the index finger and the middle finger) into the opening 122.

Referring back to FIGS. 1-3, in the illustrated example, the first and second end walls 110, 112 and the bottom end wall 114 are curved or rounded between the first and second side walls 106, 108, which creates a smooth feeling in a person's hand. In some examples, the curvature of the first and second end walls 110, 112 and the bottom end wall 114 has a radius of curvature equal to half of the distance between the first and second side walls 106, 108. In other examples, the first end wall 110, the second end wall 112, and/or the bottom end wall 114 may have a greater or smaller radius of curvature. In still other examples, the first end wall 110, the second end wall 112, and/or the bottom end wall 114 may be substantially flat or planar between the first and second side walls 106, 108 (e.g., perpendicular to the first and second side walls 106, 108).

In the illustrated example, the bottom end wall 114 is curved between the first end wall 110 and the second end wall 112, which, in some examples, enables a person to smoothly slide his/her finger(s) along the bottom end wall 114 when inverting the pocket lighter 100, for example. As shown in FIG. 2, the bottom end wall 114 has a radius of curvature defined by a radius R extending from a center of the opening 122. In other examples, the bottom end wall 114 may be curved along a radius defined by a different point. In still other examples, the bottom end wall 114 may be straight or flat between the first and second side walls 106, 108 and the first and second end walls 110, 112. For example, the body 102 may have a substantially flat bottom end wall that enables the pocket lighter 100 to stand or rest on a surface in the upright position.

As disclosed above, the opening 122 is defined by the inner surface 124 extending between the first side wall 106 and the second side wall 108. In the illustrated example, the inner surface 124 is curved or rounded between the first side wall 106 and the second side wall 108. The curved inner surface 124 forms a relatively smooth surface or taper that may assist in guiding a person's finger(s) into the opening 122, for example. In some examples, the curvature of the inner surface 124 has a radius of curvature equal to half of the distance between the first and second side walls 106, 108. In other examples, the inner surface 124 may have a greater or smaller radius of curvature. In still other examples, the inner surface 124 may extend in a perpendicular direction between the first side and the second side walls 106, 108. In the illustrated example, the opening 122 is located in a center of the first and second side walls 106, 108 between the first and second end walls 110, 112 and is located closer to the bottom end wall 114 than the open top 116. In other examples, the opening 122 may be closer to one of the first or second end walls 110, 112 and/or closer to or further from the bottom end wall 114.

The inner surface 124 defines a diameter D (FIG. 2) of the opening 122. The diameter D of the opening 122 may be any diameter that may enables persons with relatively narrow fingers and/or persons with relatively wide fingers to use the pocket lighter 100. In some examples, the diameter D of the opening 122 is between about 15 millimeters (mm) and about 25 mm. In other examples, the diameter D of the opening 122 may be smaller or larger (e.g., smaller than 15 mm or larger than 25 mm). While in the illustrated example the opening 122 is circular, in other examples, the opening 122 may be shaped differently. For example, the opening 122 may have an oval shape, a square shape, a triangular shape, etc. In some examples, the distance between the inner surface 124 defining the opening 122 and the button 118 (or one or more other part(s) of the lighter assembly 104 at the open top 116) is about 1-4 inches (25.4 mm-101.6 mm). In other examples, the distance may be smaller or larger (e.g., smaller than 1 inch or larger than 4 inches).

In the illustrated example, the nozzle 120 is slanted or angled relative to a longitudinal axis of the body 102. In some examples, having a slanted or angled nozzle enables the flame to project outward and to the side of the pocket lighter 100. In other examples, the nozzle 120 may not be angled or slanged. Instead, the nozzle 120 may be pointed upward, for example, in a direction that is aligned with a longitudinal axis of the pocket lighter 100.

In some examples, the body 102 is constructed of plastic. In other examples, the body 102 may be constructed of other materials. In some examples, the body 102 has one or more portions constructed of different materials. For example, in the illustrated example, the body 102 includes an indentation 130 formed in the first side wall 106, the second side wall 108, the first end wall 110, and the second end wall 112. The indentation 130 may separate the body 102 into an upper portion (above the indentation 130) and a lower portion (below the indentation 130). In some examples, the upper portion is constructed of one material, such as a metal or a material having a higher melting point, for example, whereas the lower portion is constructed of another material, such as a plastic or material having a lower melting point than the upper portion. In some examples, the body 102 may include a window to view the amount of lighter fluid remaining within the body 102.

In some examples, the body 102 may be constructed without the lighter assembly 104 and, instead, may be used as holder or case for a conventional pocket lighter. For instance, a conventional pocket lighter may be inserted into the cavity through the open top 116 such that the button and nozzle of the pocket lighter are facing upward. As such, the body 102 can be used to hold and use the pocket lighter in an inverted position (or another position) similar to the examples disclosed herein. Further, the pocket lighter can be removed (e.g., when the first pocket lighter is out of fluid) and another pocket lighter can be inserted into the body 102. In some examples, the cavity in the body 102 may be sized to produce a snug fit to hold the pocket lighter in the body 102 and/or the body 102 may include one or more other mechanisms (e.g., a strap) to hold the pocket lighter in the body 102.

From the foregoing, it will be appreciated that example methods, apparatus, and articles of manufacture have been disclosed that that enable a pocket lighter to be held in a person's hand and used in a manner that is different than traditional pocket lighters. The examples disclosed herein enable a person to use a pocket lighter in an inverted or non-upright orientation, for example, without having to twist his/her hand into an uncomfortable position, and which may other block the person's view of the flame. As such, the examples disclosed herein provide a safer and easier to use pocket lighter.

Although certain example methods, apparatus, and articles of manufacture have been disclosed herein, the scope of coverage of this patent is not limited thereto. On the contrary, this patent covers all methods, apparatus, and articles of manufacture fairly falling within the scope of the claims of this patent.

What is claimed is:

1. A pocket lighter comprising:

a body including:

a first side wall;

a second side wall opposite the first side wall;

a first end wall between the first side wall and the second side wall;

a second end wall between the first side wall and the second side wall opposite the first end wall; and a bottom wall between the first side wall, the second side wall, the first end wall, and the second end wall, the body including an opening extending through the body between the first side wall and the second side wall, the opening dimensioned to receive a finger of a person to enable the person to hold the pocket lighter in an inverted position, the bottom wall having a continuous curvature between the first end wall and the second end wall to enable the person to slide another finger along the bottom wall when inverting the pocket lighter; and a lighter assembly disposed at least partially in the body, the lighter assembly including a nozzle that is angled relative to a longitudinal axis of the body to enable a flame to project outward and to a side of the pocket lighter when held in the inverted position.

2. The pocket lighter of claim 1, wherein the opening has a diameter of about 15-25 millimeters.

3. The pocket lighter of claim 1, wherein the bottom wall has a constant radius of curvature between the first end wall and the second end wall.

4. The pocket lighter of claim 3, wherein the radius of curvature is defined by a radius extending from a center of the opening.

5. The pocket lighter of claim 4, wherein the radius is half of a distance between the first end wall and the second end wall.

6. The pocket lighter of claim 1, wherein the opening is circular.

7. The pocket lighter of claim 1, wherein the opening is closer to the bottom wall than to the nozzle.

8. The pocket lighter of claim 1, wherein the longitudinal axis extends through a center of the opening.

9. The pocket lighter of claim 1, wherein the lighter assembly includes a button, the button being depressible in a direction toward the bottom wall of the body.

10. The pocket lighter of claim 1, wherein the lighter assembly is a click button lighter assembly.

11. The pocket lighter of claim 1, further including a cover pivotably coupled to the body adjacent the nozzle, the cover movable between a closed position to cover the nozzle and an open position to uncover the nozzle.

12. A pocket lighter comprising:

a body including:

a first side wall;

a second side wall opposite the first side wall;

a third side wall between the first side wall and the second side wall;

a fourth side wall between the first side wall and the second side wall opposite the third side wall;

an inner surface extending between the first side wall and the second side wall and defining an opening through the body, the opening dimensioned to receive a finger of a person to enable the person to hold the pocket lighter in an inverted position, the inner surface being curved such that the inner surface has a first diameter at the first side wall and the second side wall and a second diameter in the opening that is smaller than the first diameter; and a bottom wall between the first side wall, the second side wall, the third side wall, and the fourth side wall, the bottom wall having a continuous curvature between the third side wall and the fourth side wall to enable the person to slide another finger along the bottom wall when inverting the pocket lighter; and a lighter assembly disposed at least partially in the body, the lighter assembly including a nozzle and a button to open the nozzle when the nozzle is activated, wherein a distance between the inner surface and the button is 1-4 inches.

13. A pocket lighter comprising:

a body including:

a first side wall;

a second side wall opposite the first side wall;

a third side wall between the first side wall and the second side wall;

a fourth side wall between the first side wall and the second side wall opposite the third side wall;

an inner surface extending between the first side wall and the second side wall and defining an opening through the body, the opening dimensioned to receive a finger of a person to enable the person to hold the pocket lighter in an inverted position, the inner surface being curved such that the inner surface has a first diameter at the first side wall and the second side wall and a second diameter in the opening that is smaller than the first diameter; and a bottom wall between the first side wall, the second side wall, the third side wall, and the fourth side wall, the bottom wall having a continuous curvature between the third side wall and the fourth side wall to enable the person to slide another finger along the bottom wall when inverting the pocket lighter; and a lighter assembly disposed at least partially in the body, the lighter assembly including a nozzle and a button to open the nozzle when the nozzle is activated, wherein the button is depressible in a direction toward the bottom wall.

14. The pocket lighter of claim 12, wherein the inner surface has a continuous curvature between the first side wall and the second side wall.

15. The pocket lighter of claim 12, wherein the body is constructed of plastic.

16. The pocket lighter of claim 12, wherein the opening is located at a center between the third and fourth side walls.

17. The pocket lighter of claim 12, wherein the bottom wall is curved between the first side wall and the second side wall.

18. The pocket lighter of claim 12, wherein the third side wall and the fourth side wall are curved between the first and second side walls.

19. The pocket lighter of claim 13, wherein a distance between the inner surface and the button is 1-4 inches.

20. The pocket lighter of claim 13, wherein the nozzle that is angled relative to a longitudinal axis of the body.

* * * * *